US007824082B2

(12) United States Patent
Hanson

(10) Patent No.: US 7,824,082 B2
(45) Date of Patent: Nov. 2, 2010

(54) OUTDOOR LIGHTING ASSEMBLY

(75) Inventor: Mark Hanson, Mound, MN (US)

(73) Assignee: Touchstone Accent Lighting, Inc., Long Lake, MN (US)

( * ) Notice: Subject to any disclaimer, the term of this patent is extended or adjusted under 35 U.S.C. 154(b) by 306 days.

(21) Appl. No.: 11/462,205

(22) Filed: Aug. 3, 2006

(65) Prior Publication Data

US 2007/0029459 A1 Feb. 8, 2007

Related U.S. Application Data

(60) Provisional application No. 60/705,046, filed on Aug. 3, 2005.

(51) Int. Cl.
*F21V 19/00* (2006.01)

(52) U.S. Cl. ..... 362/382; 362/188

(58) Field of Classification Search ..... 362/382, 362/383, 84, 187, 188, 198, 257, 270
See application file for complete search history.

(56) References Cited

U.S. PATENT DOCUMENTS 3,011,598 A * 12/1961 Galloway et al. ..... 52/153
3,145,934 A * 8/1964 Guggemos ..... 362/382
3,193,059 A 7/1965 Wallerstein, Jr.
3,572,581 A * 3/1971 McLeod ..... 232/35
3,805,055 A * 4/1974 Cassey ..... 362/358
4,161,723 A 7/1979 De Vittori
4,305,560 A * 12/1981 Ban ..... 248/160
4,774,648 A * 9/1988 Kakuk et al. ..... 362/302
5,062,028 A * 10/1991 Frost et al. ..... 362/183
5,068,773 A * 11/1991 Toth ..... 362/386
5,384,694 A * 1/1995 Yang ..... 362/298
5,414,608 A * 5/1995 Stekelenburg ..... 362/396
5,513,085 A * 4/1996 Bourne ..... 362/286
D376,892 S * 12/1996 Tsao ..... D99/31
5,626,418 A * 5/1997 Angelis et al. ..... 362/390
6,135,623 A * 10/2000 Lin ..... 362/431

FOREIGN PATENT DOCUMENTS

FR 745785 5/1933

* cited by examiner

*Primary Examiner*—Sandra L O'Shea
*Assistant Examiner*—Danielle Allen
(74) *Attorney, Agent, or Firm*—Fredrikson & Byron, P.A.

(57) ABSTRACT

In one aspect, the invention features a flexible base receptacle configured to be coupled to a lighting unit. The base receptacle includes a lower portion, which has a lower portion perimeter. The base receptacle includes a neck portion, which is movable relative to the lower portion. The neck portion has a lower neck portion perimeter that is proximate the lower portion. The neck portion has an upper neck portion perimeter. The neck portion has an intermediate neck portion perimeter, which is smaller than the lower neck portion perimeter and the upper neck portion perimeter. Some embodiments enable outdoor lighting assemblies to absorb forces due to bumping, thereby making it more difficult to break the outdoor lighting assemblies.

22 Claims, 9 Drawing Sheets

830
825
835
805

845
840
850
810

860
855
865
870
815

880
875
885
890
820

OUTDOOR LIGHTING ASSEMBLY

CROSS-REFERENCE TO RELATED APPLICATION

This application claims priority under 35 U.S.C. §119(e) to U.S. provisional application 60/705,046, filed Aug. 3, 2005, which is hereby incorporated by reference in relevant part.

TECHNICAL FIELD

This document relates to outdoor lighting and, more particularly, to outdoor lighting assemblies.

BACKGROUND

Proper outdoor lighting can provide numerous benefits. For example, outdoor lighting can often improve safety by illuminating potential hazards so that people can prepare for and deal with them. Similarly, outdoor lighting can often enhance security in that people are less likely to engage in illicit conduct if they think that they might be seen. Additionally, and perhaps most importantly, outdoor lighting can create a pleasing, decorative effect by highlighting the character of structures and landscapes.

Outdoor lighting assemblies come in a variety of shapes and sizes. Examples include upright lamps, floodlights, tier lights, well lights, and surface-mount lights. Moreover, outdoor lighting assemblies can be powered via high-voltage energy sources, low-power energy sources, or solar power. Outdoor lighting assemblies can be used to illuminate home architecture, decks, walkways, driveways, gardens, ponds, swimming pools, and other structures or landscapes.

In some environments, outdoor lighting assemblies can be damaged by ordinary outdoor activities. For example, people sometimes bump outdoor lighting assemblies with their lawnmowers, thereby bending or breaking the outdoor lighting assemblies. Likewise, children may damage outdoor lighting assemblies while playing outdoors. Other outdoor activities that can damage outdoor lighting assemblies involve garden hoses, ladders, landscapers, and pets. Damaging outdoor lighting assemblies becomes an even bigger issue given the fact that many outdoor lighting assemblies are designed to be relatively inconspicuous in the daylight.

SUMMARY OF THE INVENTION

In one aspect, a flexible base receptacle is configured to be coupled to a lighting unit. The base receptacle includes a lower portion, which has a lower portion perimeter. The base receptacle includes a neck portion, which is movable relative to the lower portion. The neck portion has a lower neck portion perimeter that is proximate the lower portion. The neck portion has an upper neck portion perimeter. The neck portion has an intermediate neck portion perimeter, which is smaller than the lower neck portion perimeter and the upper neck portion perimeter.

In a second aspect, a flexible base receptacle is configured to be coupled to a lighting unit. The base receptacle includes a lower cylinder portion, which has a lower portion circumference. The base receptacle includes an upper cylinder portion, which is movable relative to the lower cylinder portion. The upper cylinder portion has an upper portion circumference. The base receptacle includes a neck cylinder portion, which is movable relative to the lower cylinder portion. The neck cylinder portion has a lower neck portion circumference that is proximate the lower cylinder portion. The neck cylinder portion has an upper neck portion circumference that is proximate the upper cylinder portion. The neck cylinder portion has an intermediate neck portion circumference, which is smaller than the lower neck portion circumference and the upper neck portion circumference.

Embodiments of the flexible base receptacle may include one or more of the following features. Some flexible base receptacle embodiments include an upper portion that is proximate the upper neck portion perimeter and movable relative to the lower portion. In such embodiments, the upper portion may include an upper portion perimeter that is larger than the intermediate neck portion perimeter. In such embodiments, the lower portion perimeter may be larger than the upper portion perimeter. In such embodiments, the lower portion perimeter and the upper portion perimeter may be approximately equal. In some embodiments, the lower portion and the neck portion have circular cross-sections. Some embodiments include an insert, such as an NTP brass insert and/or a threaded insert. Some flexible base receptacle embodiments include a male lower interface. In some embodiments, the lower cylinder portion further includes a press-fit lower interface. In some embodiments, the lower portion circumference is larger than the lower portion circumference. In some embodiments, the lower cylinder portion, the neck cylinder portion, and the upper cylinder portion are integrally formed of rubber.

In a third aspect, an outdoor assembly includes an outdoor member and a flexible base receptacle. The flexible base receptacle can be configured to be coupled to the outdoor member. The flexible base receptacle includes a lower portion, which has a lower portion perimeter. The flexible base receptacle includes a neck portion, which is movable relative to the lower portion. The neck portion has a lower neck portion perimeter, which is proximate the lower portion. The neck portion has an upper neck portion perimeter. The neck portion has an intermediate neck portion perimeter, which is smaller than the lower neck portion perimeter and the upper neck portion perimeter.

Embodiments of the outdoor assembly may include one or more of the following features. The outdoor member could include a mailbox or a lighting unit. The flexible base receptacle could include any of the features discussed elsewhere herein. Some outdoor assembly embodiments include a tube configured to be coupled to the lower portion and a stake configured to be coupled to the tube. In such embodiments, the stake and the tube can be configured to be buried. Some outdoor assembly embodiments include a stake configured to be coupled to the lower portion and configured to be buried. Some outdoor assembly embodiments include a connector that is configured to interface with the flexible base receptacle and with the outdoor member.

Embodiments of the present invention may have one or more of the following advantages. Some embodiments enable outdoor lighting assemblies to absorb forces due to bumping, thereby making it more difficult to break the outdoor lighting assemblies. In some embodiments, lighting units can be bent over for easier lamp/bulb replacement and servicing. In some embodiments, tubes and/or stakes keep the outdoor lighting assemblies firmly planted in the ground in all types of weather and soil conditions. In some embodiments, a user can change lighting units by using various connectors, thereby eliminating the need for changing the entire outdoor lighting assembly. Some embodiments work with all different types of lighting units. Some embodiments work in above-ground settings (e.g., decks). Some embodiments have the potential to be used in any setting in which a pole extends upwardly. Some embodiments provide all of the desired functionality discussed herein while remaining relatively inconspicuous.

DETAILED DESCRIPTION OF ILLUSTRATIVE EMBODIMENTS

The following detailed description of illustrative embodiments should be read with reference to the figures, in which like elements in different figures are numbered identically. The figures depict illustrative embodiments and are not intended to limit the scope of the invention. Rather, the present invention is defined solely by the claims.

Figure 1:
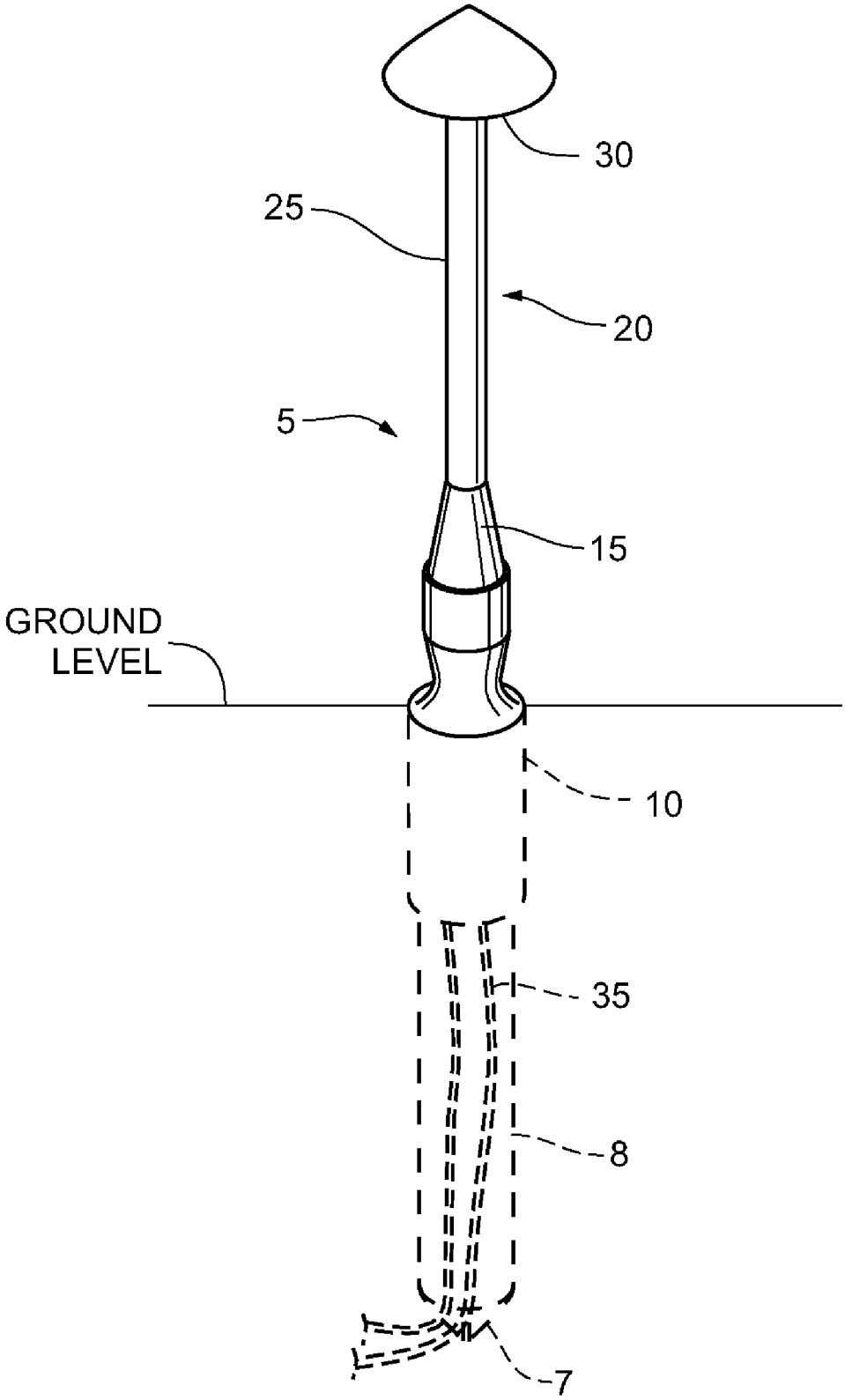
FIG. 1 is a perspective view of an outdoor lighting assembly according to some embodiments of the present invention.
Figure 2A:
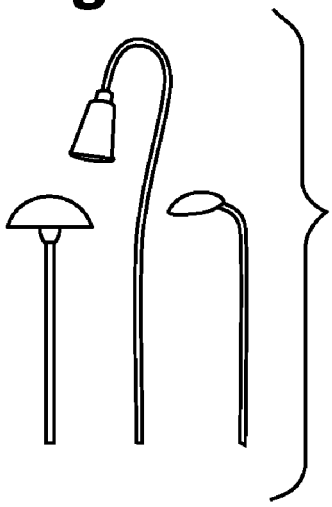
FIGS. 2A-2D are perspective views of lighting units that can be used in connection with some embodiments of the present invention.
Figure 2B:
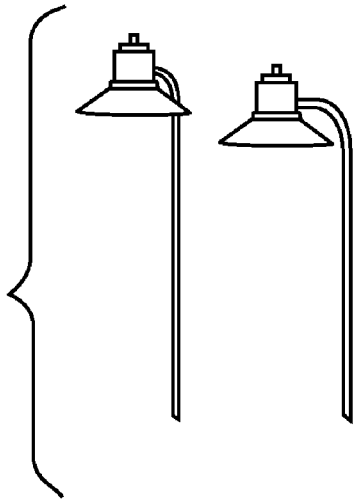
Figure 2C:
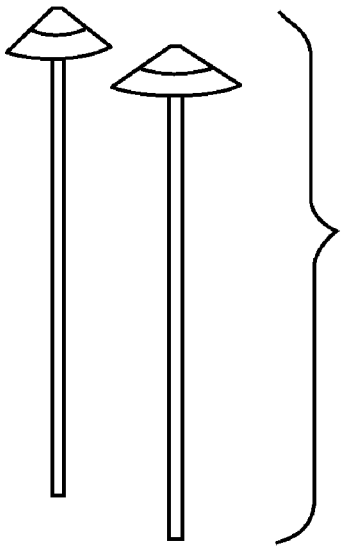
Figure 2D:
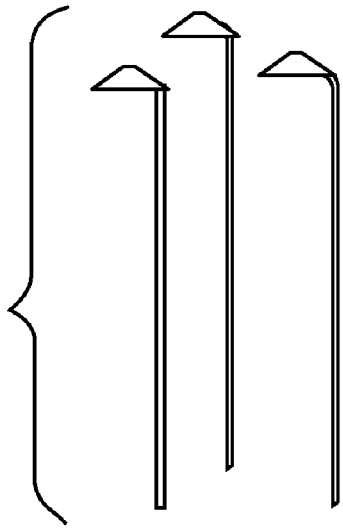

FIG. 1 shows an embodiment of an outdoor lighting assembly 5. The outdoor lighting assembly 5 of FIG. 1 includes a stake 7, a tube 8, a base receptacle 10, a connector 15, and a lighting unit 20. With the stake 7, the tube 8, and the base receptacle 10 coupled together, a user can prepare the outdoor lighting assembly 5 for operation by burying it partially in the ground. In operation, the stake 7, the tube 8, and part of the base receptacle 10 can be buried underground, while the remainder of the base receptacle 10, the connector 15, and the lighting unit 20 can extend vertically from the ground. The tube 8 can be made of, e.g., PVC, and can extend far enough underground to ensure that electrical wires are buried at an adequate depth.

The lighting unit 20 of FIG. 1 is an upright lamp. It includes a pole 25, a shade 30, wires 35, a light socket, and a light bulb. In embodiments in which the lighting unit 20 is an upright lamp, the lighting unit 20 may take various forms and may come in various styles. For example, the length of the pole 25 may be varied to adjust the diameter of illumination, to create a desired appearance of the lighting unit 20, or for any other reason. The diameter of the pole 25 may be varied. FIGS. 2A-2D show various illustrative embodiments of lighting units that can be used in some outdoor lighting assembly embodiments.

In the embodiment of FIG. 1, the lighting unit 20 and the connector 15 can be coupled to the base receptacle 10. The pole 25 of the lighting unit 20 can be inserted into a bore in the connector 15 to couple the lighting unit 20 and the connector 15 together. The connector 15 can also be coupled to the base receptacle 10. Connectors can allow a common base receptacle to interface with many different lighting units having poles of differing diameters. As such, a user can change lighting units without having to dig up the base receptacle.

FIGS. 3A-3D show a closer view of the base receptacle 10 of FIG. 1. The base receptacle 10 includes an insert 55, a locking device 60, and a multi-portioned cylinder 50. In many instances, the base receptacle 10 can make the outdoor lighting assembly less susceptible to damage caused by ordinary outdoor activities. For example, if the outdoor lighting assembly is bumped by a lawnmower, the base receptacle 10 can allow the outdoor lighting assembly to flex temporarily before returning to its original position rather than breaking. The multi-portioned cylinder 50 shown in FIGS. 3A-3D has three portions: a lower cylinder portion 65, a neck cylinder portion 70, and an upper cylinder portion 75. The three cylinder portions 65, 70, 75 may be integrally formed of the same material, such as an elastomer (e.g., rubber) or other flexible material. The three cylinder portions 65, 70, 75 shown in FIGS. 3A-3D are coaxial.

The multi-portioned cylinder 50 of the base receptacle 10 may be configured in a variety of ways. In some embodiments, the perimeter of the lower cylinder portion 65 (i.e., the circumference for lower portions having circular cross-sections) may be greater than the perimeters of either the neck cylinder portion 70 or the upper cylinder portion 75. In such embodiments, the lower cylinder portion 65 can be sized to interface with a tube (e.g., tube 8 of FIG. 1, tube 180 of FIG. 6). In some embodiments, the perimeter of the lower cylinder portion 65 can be between approximately 4 inches (10.16 centimeters) and 30 inches (76.2 centimeters). In some embodiments, the perimeter of the lower cylinder portion 65 can be between approximately 5 inches (12.7 centimeters) and 12 inches (30.48 centimeters). In some embodiments, the perimeter of the lower cylinder portion 65 is approximately 5.65 inches (14.351 centimeters). In some embodiments, the perimeter of the lower cylinder portion 65 is approximately 8.5 inches (21.59 centimeters). In some embodiments, the perimeter of the lower cylinder portion 65 is approximately 11.78 inches (29.921 centimeters).

In embodiments of the base receptacle 10 that include an upper cylinder portion 75, the upper cylinder portion 75 can be configured in a variety of ways. In some embodiments, the perimeter of the upper cylinder portion 75 can be between approximately 2.25 inches (5.715 centimeters) and 28 inches (71.12 centimeters). In some embodiments, the perimeter of the upper cylinder portion 75 can be between approximately 5.25 inches (13.335 centimeters) and 7.25 inches (18.415 centimeters). In some embodiments, the perimeter of the upper cylinder portion 75 is approximately 5.65 inches (14.351 centimeters).

The neck cylinder portion 70 of the base receptacle 10 can be configured in a variety of ways. In some embodiments, the uppermost and lowermost perimeters of the neck cylinder portion 70 are large relative to the perimeter at the narrowest cross-section of the neck cylinder portion 70. In some embodiments, the lowermost perimeter of the neck cylinder portion 70 may be approximately equal to the perimeter of the lower cylinder portion 65. Embodiments of the neck cylinder portion 70 can have lowermost perimeters within the same ranges as those discussed in connection with the lower cylinder portion 65. In some embodiments, the lowermost perimeter of the neck cylinder portion 70 may be slightly smaller than the perimeter of the lower cylinder portion 65. In some embodiments, the lowermost perimeter of the lower cylinder portion 65 is approximately 7.5 inches (19.05 centimeters). In some embodiments, the lowermost perimeter of the neck cylinder portion 70 differs from the perimeter of the lower cylinder portion 65. In some embodiments, the uppermost perimeter of the neck cylinder portion 70 may be approximately equal to the perimeter of the upper cylinder portion 75. Embodiments of the neck cylinder portion 70 can have uppermost perimeters within the same ranges as those discussed in connection with the upper cylinder portion 75. In some embodiments, the uppermost perimeter of the neck cylinder portion 70 differs from the perimeter of the upper cylinder portion 75.

Figure 3B:
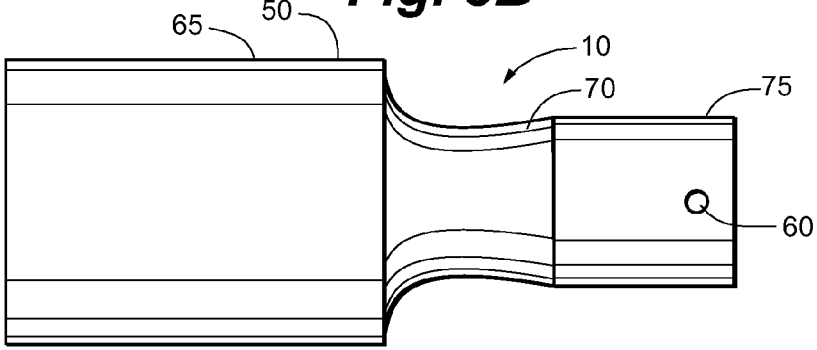
FIGS. 3A-3D are views of the base receptacle of FIG. 1.
Figure 3D:
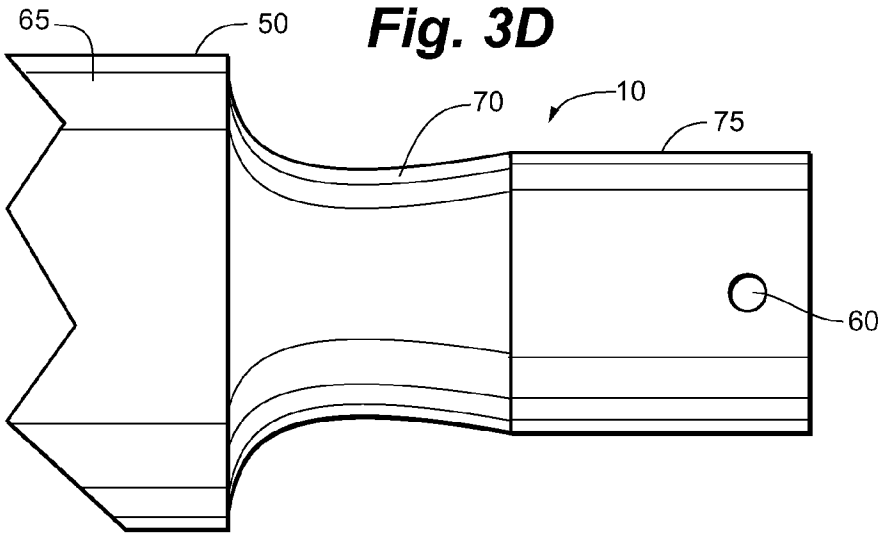
Figure 3A:
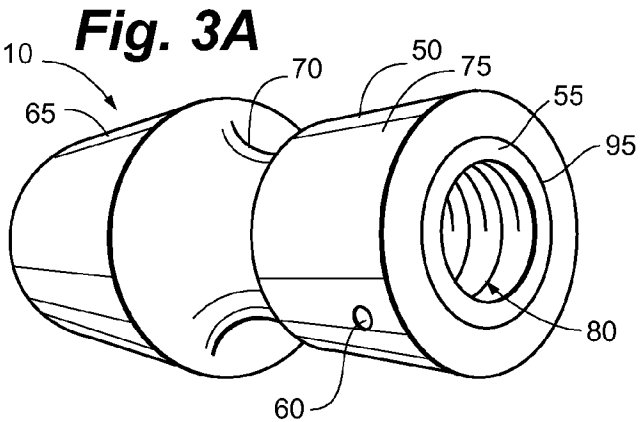
Figure 3C:
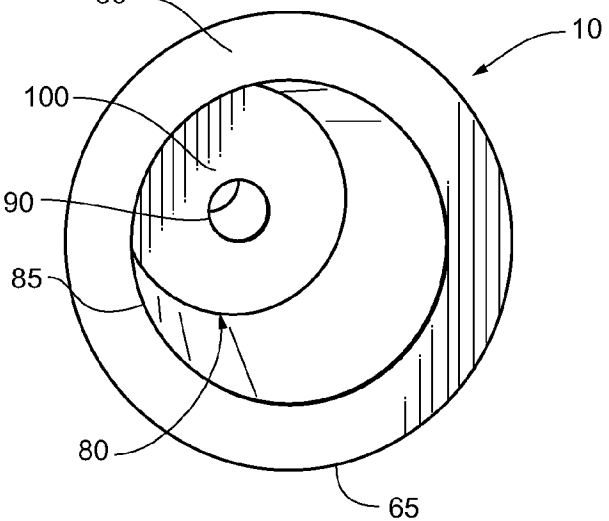
Figure 4A:
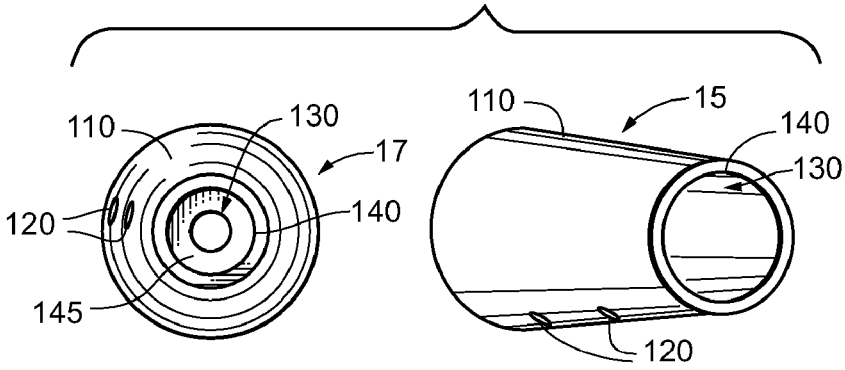
FIGS. 4A-4E are views of the connector of FIG. 1.
Figure 4B:
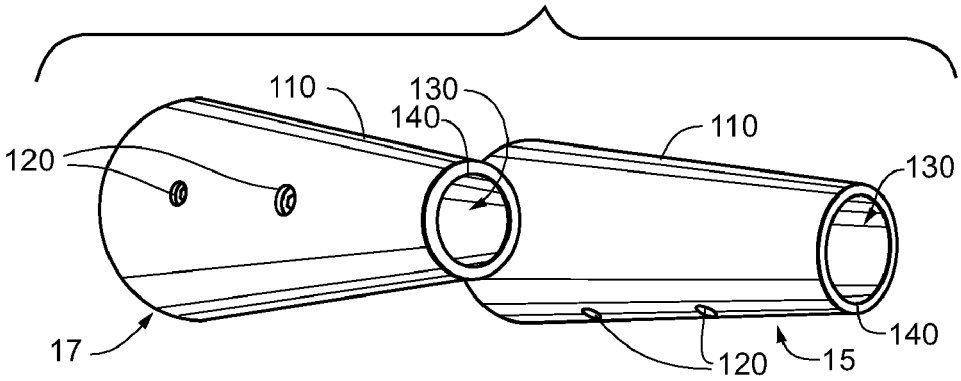
Figure 4C:
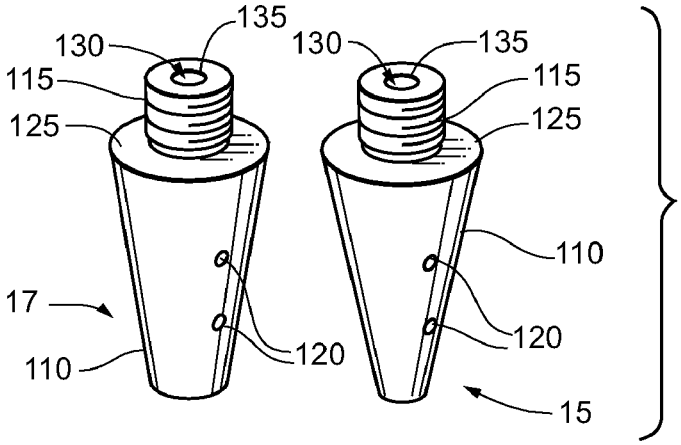
Figure 4D:
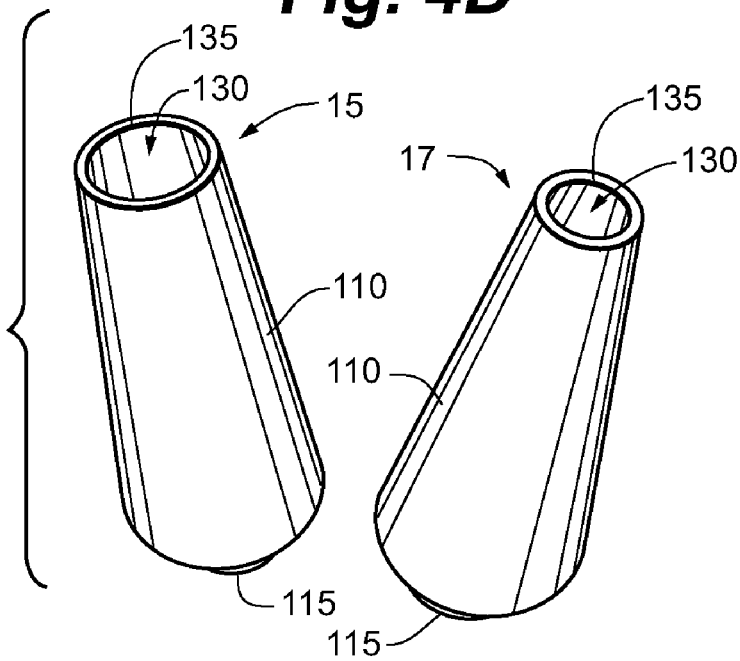
Figure 4E:
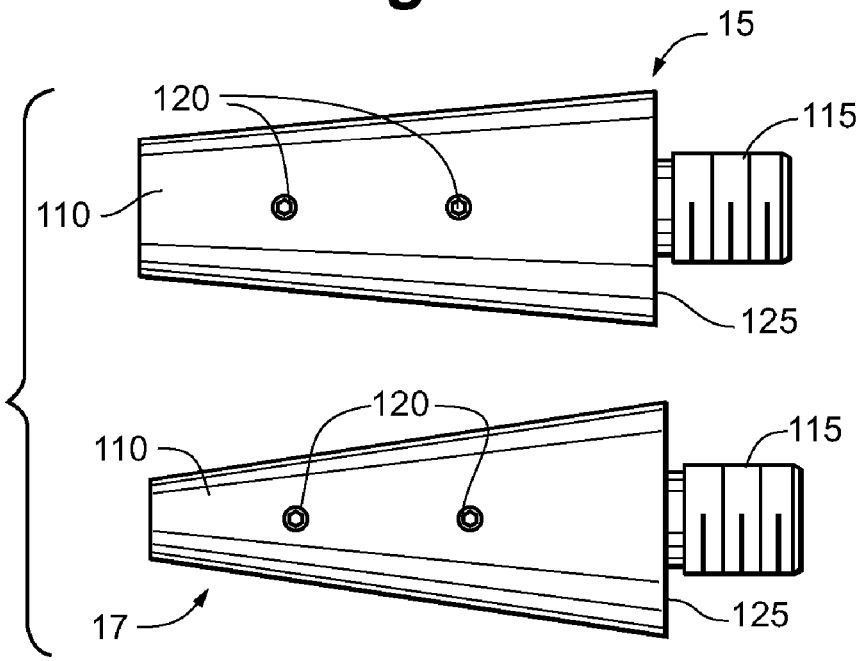
Figure 5B:
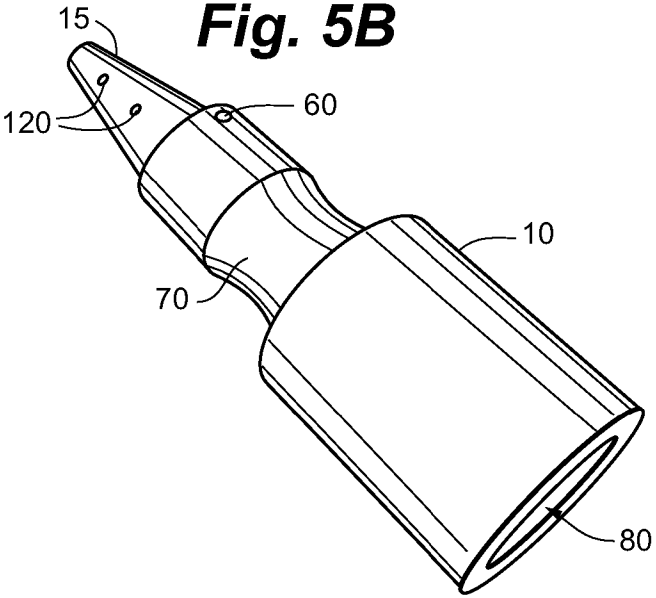
FIGS. 5A-5F are views of several stages of processes for assembling an outdoor lighting assembly that can be used in some embodiments of the present invention.
Figure 5A:
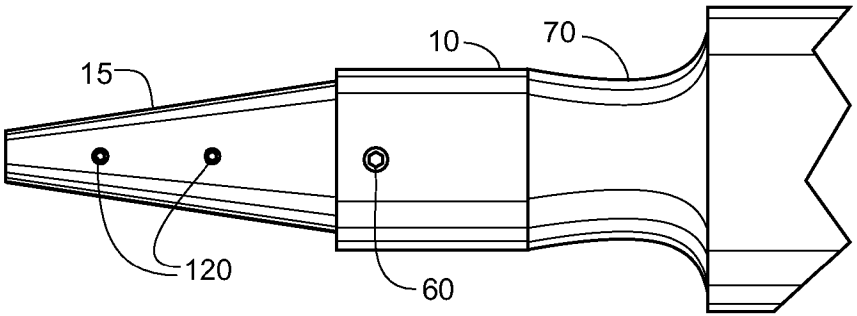
Figure 5C:
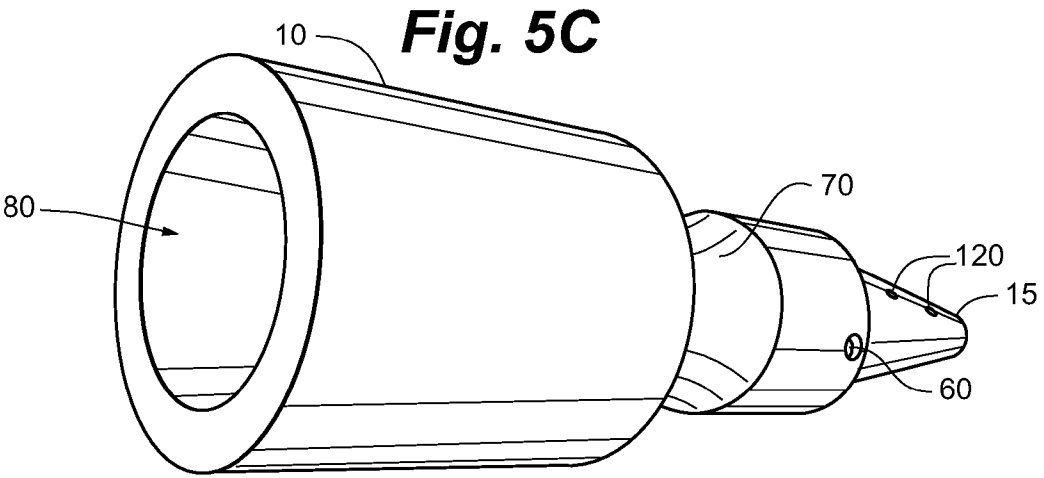
Figure 5E:
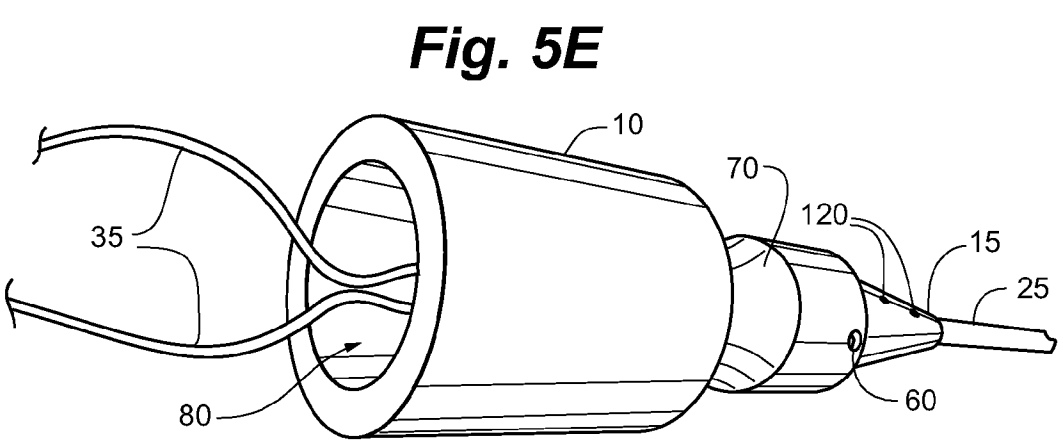
Figure 5F:
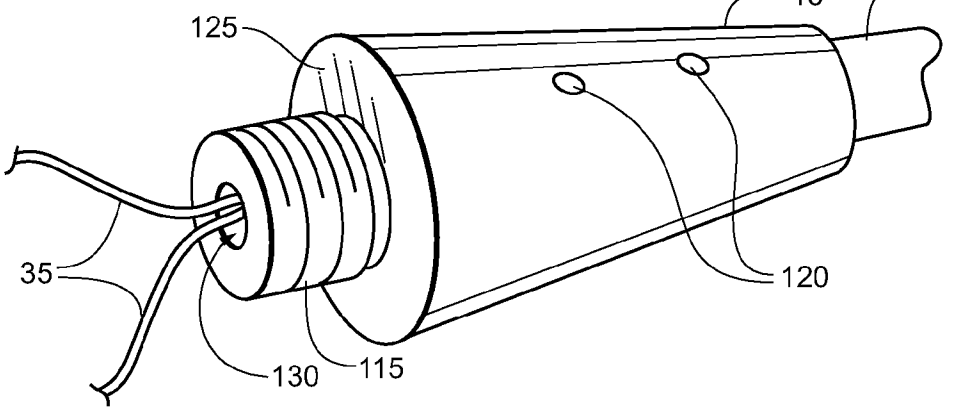
Figure 5D:
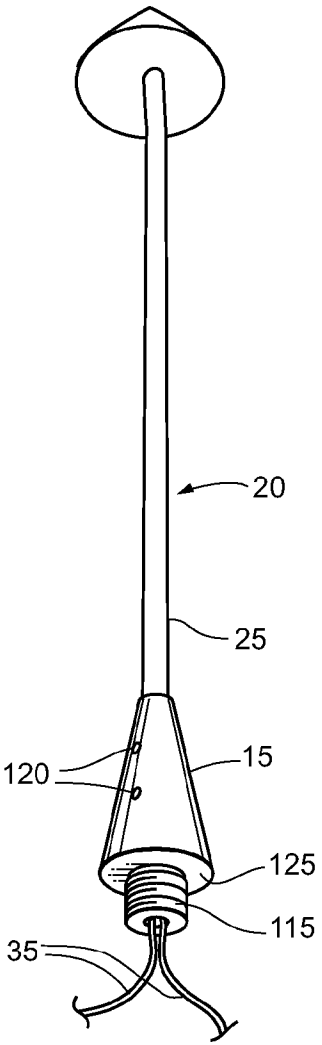

As is shown most clearly in FIGS. 3B & 3D, the perimeter of the neck cylinder portion 70 may vary along its profile. In some embodiments, the smallest perimeter of the neck cylinder portion 70 can be between approximately 1.75 inches (4.445 centimeters) and 21.75 inches (55.245 centimeters). In some embodiments, the smallest perimeter of the neck cylinder portion 70 can be between approximately 2.5 inches (63.5 centimeters) and 6.25 inches (15.875 centimeters). In some embodiments, the smallest perimeter of the neck cylinder portion 70 is approximately 4.375 inches (11.11 centimeters). In some embodiments, the smallest perimeter of the neck cylinder portion 70 is closer to the lowermost perimeter than to the uppermost perimeter. In some embodiments, the ratio of the distance between the smallest perimeter and the uppermost perimeter to the distance between the smallest perimeter and the lowermost perimeter can be approximately between 1.25:1 and 4:1. In some embodiments, such ratio can be approximately between 2:1 and 2.5:1 (e.g., 2.25:1). In some embodiments, the smallest perimeter of the neck cylinder portion 70 is closer to the uppermost perimeter than to the lowermost perimeter. In some embodiments, the distance between the smallest perimeter and the uppermost perimeter is approximately equal to the distance between the smallest perimeter and the lowermost perimeter. In some embodiments involving a large moment arm (e.g., the base receptacle supports a relatively heavy component connected to the upper end of a relatively heavy pole), the lower half of the neck cylinder portion 70 can be more robust (e.g., can include more material) than the upper half. In some embodiments involving a small moment arm, the upper cylinder portion 75 and the lower cylinder portion can be approximately equally robust.

Base receptacles of outdoor lighting assemblies can come in a variety of shapes and sizes. For example, the lower portion of the base receptacle may have a polygonal, rather than circular, cross-section. The lower portion's cross section may be, for example, pentagonal or hexagonal. The neck portion and/or upper portion may have a cross section similar to the lower portion (e.g., all three cross-sections are circular, polygonal or other suitable cross section). In some embodiments, the three portions have different types of cross sections (e.g., the lower portion has a circular cross section, the neck portion has a hexagonal cross-section, and the upper portion has a pentagonal cross section). In some embodiments, only two of the three portions have the same type of cross section (e.g., the upper and lower portions are circular while the neck portion is polygonal). The base receptacle may include only a lower portion and a neck portion. The portions of the base receptacle may be separated by distinct changes in cross-section. The cross section of the base receptacle may transition seamlessly from one portion to the next. In some embodiments, the perimeter of the lower portion is approximately equal to that of the upper portion.

Base receptacles can be coupled to a variety of components in a variety of ways. The upper end of a base receptacle can be coupled to, e.g., a connector (such as connector 15 of FIG. 1 or a connector that enables a female interface to mate with a female interface), the base of a lighting unit (such as pole 25 of FIG. 1), standard electrical fittings, or other suitable components. The lower end of a base receptacle can be coupled to, e.g., a relatively short stake (see FIGS. 7A-7C) for situations in which electrical wires are to be buried relatively shallowly, a relatively long tube (e.g., tube 8 of FIG. 1) for situations in which electrical wires are to be buried relatively deeply, an electrical box (either directly or via a connector that allows an electrical box having a female interface to be coupled to a base receptacle having a female interface), or other suitable components. In some embodiments, such as the embodiment of FIGS. 3A-3D, the base receptacle can have a female interface at its lower end and a female interface at its upper end. In such embodiments, the components that correspond to both the lower and upper ends of the base receptacle can have male interfaces. In some embodiments, the base receptacle can have male interfaces at both its upper and lower ends. In such embodiments, the components that correspond to both the lower and upper ends of the base receptacle can have female interfaces. In some embodiments, the interface at the upper end of the base receptacle differs from the interface at the lower end of the base receptacle (e.g., the upper end has a male interface and the lower end has a female interface, or vice versa). In some embodiments, the interface of the base receptacle and the interface of the corresponding component can have cooperating threads. In such embodiments, the base receptacle and the corresponding component can be screwed together. In some embodiments, the interface of the base receptacle and the interface of the corresponding component can be configured to be coupled together by press fitting. Many additional methods for coupling base receptacles to corresponding components are possible.

As discussed above, the base receptacle 10 of FIGS. 3A-3D has a female interface at its upper end. The base receptacle 10 of FIGS. 3A-3D includes an insert 55. The insert 55 may be threaded and may be capable of receiving a component having cooperating threads. In some embodiments, the insert can be proximate the lower cylinder portion 65. The insert 55 may be made of any suitable metal, polymer, or other suitable material. In some embodiments, the insert 55 is a ½ inch (1.27 centimeter) NTP brass insert. An axial bore extends through the insert 55 of FIGS. 3A-3D. The inner and outer diameters of the insert 55 may be varied according to the configuration of the multi-portioned cylinder 50, the configuration of the corresponding component, or for any suitable reason.

Some embodiments of the base receptacle 10 include a locking device 60 to secure a corresponding component into the base receptacle 10. In the embodiment of FIGS. 3A-3D, the locking device 60 includes an Allen screw that extends through a radial bore in the multi-portioned cylinder 50 and through a radial bore in the insert 55. The locking device 60 may be translated radially with respect to the multi-portioned cylinder 50 and the insert 55 between a secure position in which the locking device 60 contacts the corresponding component and a free position in which the locking device 60 does not contact the corresponding component. In some embodiments, the locking device 60 may be translated radially by, e.g., screwing an Allen screw into and out of the radial bores with an Allen wrench. In some embodiments, an ordinary screw may perform the function of the locking device 60. Many other locking devices are possible. For example, in base receptacles having one or more male interfaces, the locking device can be incorporated into the corresponding component. In some embodiments, the locking device can be an adhesive that couples a corresponding component and a base receptacle together.

An axial bore 80 extends through the multi-portioned cylinder 50 of FIGS. 3A-3D. The axial bore 80 may include a lower bore portion 85, a middle bore portion 90, and an upper bore portion 95. The lower bore portion 85, as is shown most clearly in FIG. 3C, may be housed entirely within the lower cylinder portion 65. The diameter of the lower bore portion 85 may be greater than the diameters of either the middle bore portion 90 or the upper bore portion 95. The middle bore portion 90 may be housed within all of the cylinder portions 65, 70, 75 and may extend through the entire neck cylinder portion 70. A lower ridge 100 may exist at the interface of the lower bore portion 85 and the middle bore portion 90. The lower bore portion 85 may be configured to receive a tube (such as tube 8 of FIG. 1). The tube may be inserted into the lower bore portion 85 and may be prevented from being inserted any further by the lower ridge 100. The diameter of the upper bore portion 95 may be greater than that of the middle bore portion 90. The upper bore portion 95 may be housed entirely within the upper cylinder portion 75. An upper ridge may exist at the interface of the upper bore portion 95 and the middle bore portion 90. The upper bore portion 95 may be configured to receive a cylindrical member. The cylindrical member may be inserted into the upper bore portion 95 and may be prevented from being inserted any further by the upper ridge. In the embodiment shown in FIGS. 3A-3D, the insert 55 may be inserted into the upper bore portion 95 and may be prevented from being inserted any further by the upper ridge. In some embodiments, the upper bore portion 95 may include threads. In such embodiments, the insert 55 may be unnecessary for interfacing with components having threads.

Referring back to FIG. 1, the outdoor lighting assembly 5 includes a connector 15. The connector 15 of FIG. 1 and a second connector 17 are shown in FIGS. 4A-4E. The connectors 15, 17 may each have a conical portion 110, a threaded portion 115, and two Allen screws 120. The threaded portion 115 may be a standard configuration so that the connectors 15, 17 may fit into a standard-sized receptacle (e.g., the insert 55 of FIGS. 3A-3D). An exterior ridge 125 may exist at the interface of the conical portion 110 and the threaded portion 115. When the threaded portion 115 is screwed into a receptacle, the exterior ridge 125 may contact the receptacle, thereby preventing the threaded portion 115 from being screwed into the receptacle any further. The conical portion 110 and the threaded portion 115 may be coaxial. As shown, the upper exterior diameter of connector 15 may be greater than that of connector 17. The Allen screws 120 may extend through radial bores and may be translated radially with respect to the conical portion 110 between a secure position in which the Allen screws 120 are configured to contact a member housed within the connector 15 and a free position in which the Allen screws 120 are not configured to contact a member housed within the connector 15. The Allen screws 120 may be translated radially by, for example, screwing them into and out of the radial bores with an Allen wrench. In some embodiments, ordinary screws may perform the function of the Allen screws 120.

An axial bore 130 may extend through each connector 15, 17. The axial bore 130 may include a lower bore portion 135 and an upper bore portion 140. The lower bore portion 135 may extend entirely through the threaded portion 115. The upper bore portion 140 may be housed entirely within the conical portion 110. The diameter of the upper bore portion 140 may be greater than the diameter of the lower bore portion 135. The diameter of the upper bore portion 140 of connector 15 may be greater than the diameter of the upper bore portion 140 of connector 17. An interior ridge 145 may exist at the interface of the upper bore portion 140 and the lower bore portion 135. When a cylindrical member (e.g., pole 25 of FIG. 1) is inserted into the upper bore portion 140, the cylindrical member may contact the interior ridge 145, thereby preventing further insertion of the cylindrical member into the connector 15, 17. Connectors can be configured to interface with cylindrical members having a variety of diameters.

Figure 7A:
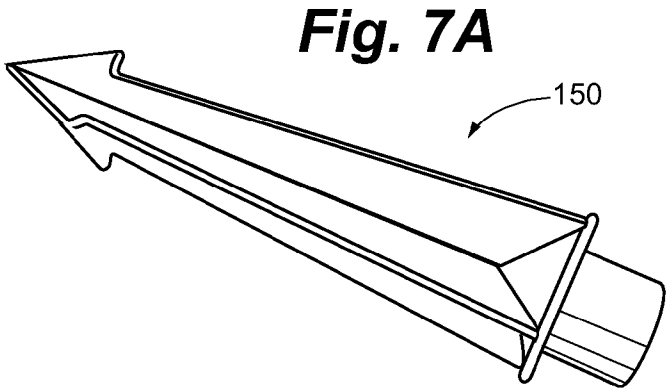
FIGS. 7A-7C are views of a stake that can be used in some embodiments of the present invention.
Figure 7B:
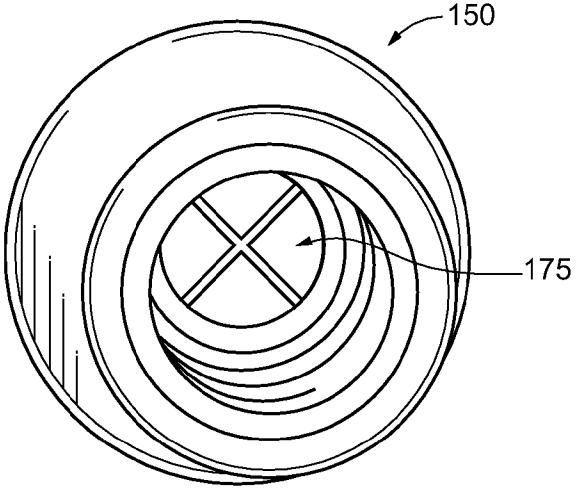
Figure 7C:
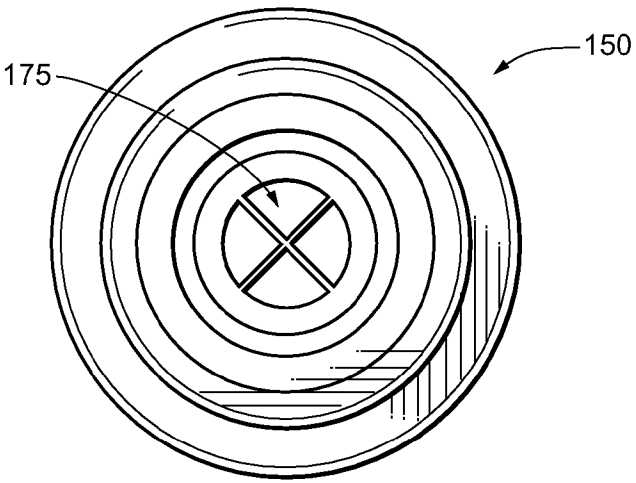
Figure 6:
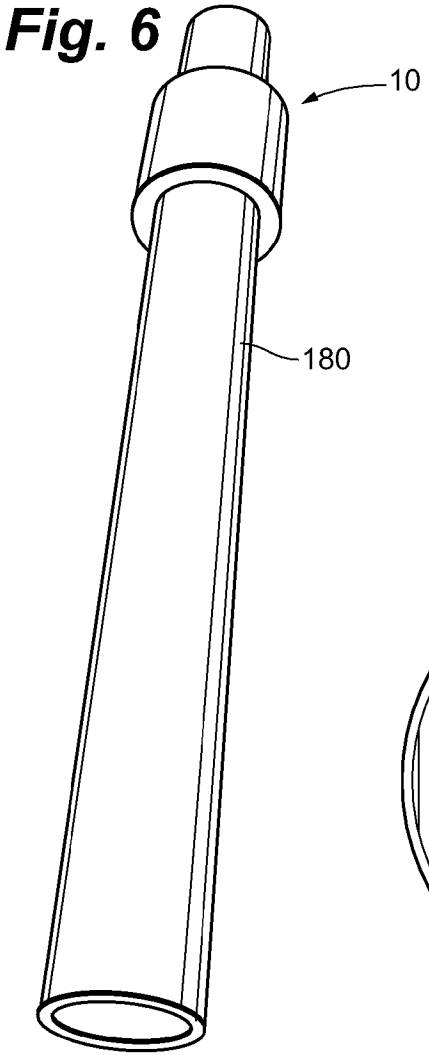
FIG. 6 is a perspective view of a tube and a base receptacle similar to those of FIG. 1.
Figures 8A, 8B, 8C, 8D:
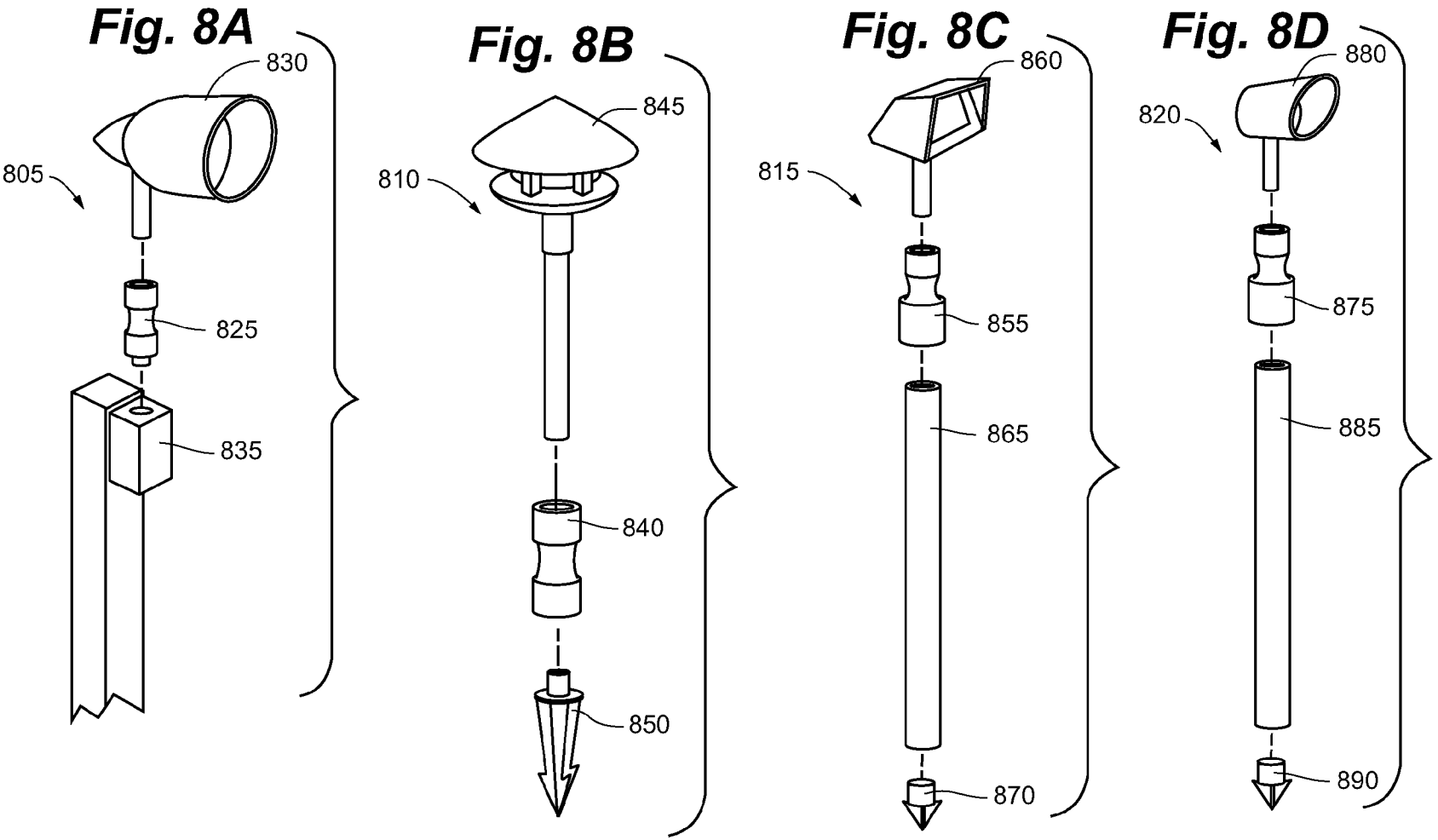
FIGS. 8A-8D are perspective views of outdoor lighting assemblies according to some embodiments of the present invention.

To assemble the outdoor lighting assembly 5 of FIG. 1, an operator may connect the lighting unit 20 to the connector 15 and connect the connector 15 to the base receptacle 10. FIGS. 5A-5F show several stages of the assembly process. In some instances, the stake, the tube, and the base receptacle 10 are positioned in the ground before the lighting unit 20 and connector 15 are connected to the base receptacle 10. FIG. 6 shows a tube 180 similar to that of FIG. 1 that can be used to ensure that electrical wires are buried to a sufficient depth. The tube 180 can be cut to the desired depth. The tube 180 of FIG. 6 can be used with a stake similar to that of FIG. 1. FIGS. 7A-7C show a stake 150 that can be used when burying electrical wires to a specific depth is less important. Electrical wires can be fed through an aperture 175, and a base receptacle can be coupled to the stake 150.

Referring again to FIGS. 5A-5F, an operator may connect the lighting unit 20 to the connector 15. To do so, the operator may insert the wires 35 through the axial bore 130 in the connector 15. The operator may insert the pole 25 into the upper bore portion of the connector 15. The outdoor lighting assembly may be configured such that the outer diameter of the pole 25 is substantially equal to the inner diameter of the upper bore portion, thereby providing for a snug fit. Poles with smaller outer diameters may be used in connection with other connectors (e.g., connector 17 of FIGS. 4A-4E). The Allen screws 120 of the connector 15 may be translated radially toward the center of the multi-portioned axial bore 130. The Allen screws 120 may press against the pole 25, thereby creating or increasing frictional force that prevents the pole 25 from being removed from the upper bore portion.

In instances in which the stake, the tube, and the base receptacle 10 are buried first, the lighting unit 20 and connector 15 can be connected to the base receptacle 10 after the appropriate electrical connections have been made. To connect the connector 15 to the base receptacle 10, the operator may insert the wires 35 through the axial bore 80 of the base receptacle 10. The operator may screw the threaded portion 115 of the connector 15 into the insert of the base receptacle 10. The exterior ridge 125 of the connector 15 may contact the upper surface of the base receptacle, thereby preventing the connector 15 from screwing further into the base receptacle 10. The Allen screw 60 of the base receptacle 10 may be translated radially to contact the threaded portion 115 of the connector 15 and secure the connector 15 in position. The order of assembly of the outdoor lighting assembly disclosed in the preceding paragraphs is illustrative. The outdoor lighting assembly may be assembled in any suitable order.

The base receptacle 10 may be made of flexible material to prevent the outdoor lighting assembly 5 from being broken by the exertion of horizontal forces on the pole 25. For example, if a man was mowing his lawn and bumped his lawnmower into the pole 25, the neck cylinder portion 70 may allow some deflection of the pole 25, thereby absorbing some of the force exerted on the pole 25. In such a situation, a lighting assembly that did not include a flexible base receptacle may have been broken due to the impact of the lawnmower. In any of the embodiments disclosed in this document, an electrical socket may be provided accompanying the base receptacle 10. The electrical socket may make it easier to assemble and disassemble the lighting unit 20 and/or connector 15 from the base receptacle 15, while leaving the base receptacle 10 in the ground.

FIGS. 8A-8D show outdoor lighting assemblies 805, 810, 815, 820 according to some embodiments of the present invention. The outdoor lighting assembly 805 of FIG. 8A includes a base receptacle 825 (with a lower male interface and an upper female interface) that is to be coupled to a flood/spot light 830 and an electrical box 835. The outdoor lighting assembly 810 of FIG. 8B includes a base receptacle 840 that is to be coupled to a pathway garden fixture light 845 and a stake 850 (similar to that of FIGS. 7A-7C). Note that in FIG. 8B, the pole of the light 845 is to be coupled directly to the base receptacle 840, without the need for a connector. The outdoor lighting assembly 815 of FIG. 8C includes a base receptacle 855 that is to be coupled to a floodlight light 860 and a tube 865, which is to be coupled to a stake 870 (similar to that of FIG. 1). The outdoor lighting assembly 820 of FIG. 8D includes a base receptacle 875 that is to be coupled to a flood/spot light 880 and a tube 885, which is to be coupled to a stake 890 (similar to that of FIG. 1).

Base receptacles similar to those disclosed above may be used in outdoor members other than outdoor lighting assemblies. For example, base receptacles made of flexible material may be used in connection with flagpoles, mailboxes, street signs, or other members that may extend from the base receptacle. In such embodiments, the base receptacle made of flexible material may prevent the member from breaking when subjected to a force by absorbing a portion of the force.

Thus, illustrative embodiments of outdoor lighting assemblies are disclosed. One skilled in the art will appreciate that outdoor lighting assemblies can be practiced with embodiments other than those disclosed. The disclosed embodiments are presented for purposes of illustration and not limitation.

What is claimed is:

1. A flexible base receptacle configured to be coupled to a lighting unit, the base receptacle comprising:

a lower portion including a lower portion perimeter; and a neck portion being movable relative to the lower portion, the neck portion including a lower neck portion that is proximate the lower portion, an upper neck portion, and an intermediate neck portion, wherein the neck portion has a perimeter that is smaller in the intermediate neck portion than in the lower neck portion and the upper neck portion, and wherein the perimeter is tapered to vary smoothly from the lower neck portion to the upper neck portion;

wherein the flexible base receptacle is made of an elastomeric material that allows the lighting unit to flex temporarily when bumped before returning to its original position.

2. The base receptacle of claim 1, further comprising an upper portion that is proximate the upper neck portion and movable relative to the lower portion, the upper portion including an upper portion perimeter that is larger than the intermediate neck portion.

3. The base receptacle of claim 2, wherein the lower portion perimeter is larger than the upper portion perimeter.

4. The base receptacle of claim 2, wherein the lower portion perimeter and the upper portion perimeter are approximately equal.

5. The base receptacle of claim 1, wherein the lower portion and the neck portion have circular cross-sections.

6. The base receptacle of claim 1, further comprising an insert comprising a female interface.

7. The base receptacle of claim 6, wherein the insert comprises an NTP brass insert.

8. The base receptacle of claim 6, wherein the insert is threaded for receiving a component having cooperating threads by screwing together.

9. The base receptacle of claim 1, further comprising a male lower interface.

10. An outdoor assembly, comprising:

an outdoor member; and a flexible base receptacle configured to be coupled to the outdoor member, the flexible base receptacle including a lower portion having a lower portion perimeter and a neck portion being movable relative to the lower portion, the neck portion having a lower neck portion that is proximate the lower portion, an upper neck portion, and an intermediate neck portion, wherein the neck portion has a perimeter that is smaller in the intermediate neck portion than in the lower neck portion and the upper neck portion, wherein the perimeter of the neck portion is tapered to vary smoothly from the lower neck portion to the upper neck portion, and wherein the flexible base receptacle is made of an elastomeric material that allows the outdoor member to flex temporarily when bumped before returning to its original position.

11. The outdoor assembly of claim 10, wherein the outdoor member comprises a lighting unit.

12. The outdoor assembly of claim 10, wherein the flexible base receptacle further includes an upper portion that is proximate the upper neck portion and movable relative to the lower portion, the upper portion having an upper portion perimeter that is larger than the intermediate neck portion.

13. The outdoor assembly of claim 12, wherein the lower portion perimeter is larger than the upper portion perimeter.

14. The outdoor assembly of claim 10, wherein the lower portion and the neck portion have circular cross-sections.

15. The outdoor assembly of claim 10, further comprising:

a tube configured to be coupled to the lower portion; and a stake configured to be coupled to the tube, the stake and the tube being configured to be buried.

16. The outdoor assembly of claim 10, further comprising a stake configured to be coupled to the lower portion and configured to be buried.

17. The outdoor assembly of claim 10, further comprising a connector configured to interface with the flexible base receptacle and with the outdoor member.

18. A flexible base receptacle configured to be coupled to a lighting unit, the base receptacle comprising:

a lower cylinder portion including a lower portion circumference;

an upper cylinder portion that is movable relative to the lower cylinder portion, the upper cylinder portion including an upper portion circumference; and a neck cylinder portion that is movable relative to the lower cylinder portion, the neck cylinder portion including a lower neck portion that is proximate the lower cylinder portion, an upper neck portion that is proximate the upper cylinder portion, and an intermediate neck portion, wherein the neck cylinder portion has a circumference that is smaller in the intermediate neck portion than in the lower neck portion and the upper neck portion, and wherein the neck cylinder portion is tapered such that the circumference varies smoothly from the lower neck portion to the upper neck portion;

wherein the flexible base receptacle is made of an elastomeric material that allows the lighting unit to flex temporarily when bumped before returning to its original position.

19. The base receptacle of claim 18, further comprising a threaded NTP brass insert for cooperating with a corresponding component by threading, wherein the insert comprises a female interface.

20. The base receptacle of claim 18, wherein the lower cylinder portion further includes a press-fit lower interface.

21. The base receptacle of claim 18, wherein the lower cylinder portion, the neck cylinder portion, and the upper cylinder portion are integrally formed of rubber.

22. The base receptacle of claim 1, wherein the flexible base receptacle is made of rubber.

* * * * *